166-66 SR
M7219 XR 4,192,380

United States Patent [19]
Smith

[11] 4,192,380
[45] Mar. 11, 1980

[54] METHOD AND APPARATUS FOR LOGGING INCLINED EARTH BOREHOLES

[75] Inventor: John R. E. Smith, Houston, Tex.

[73] Assignee: Dresser Industries, Inc., Dallas, Tex.

[21] Appl. No.: 947,680

[22] Filed: Oct. 2, 1978

[51] Int. Cl.[2] ..... E21B 47/00
[52] U.S. Cl. ..... 166/250; 166/65 R; 166/104; 254/134.5
[58] Field of Search ..... 166/250, 254, 255, 301, 166/64–66, 67, 72, 104, 264, 113; 175/94, 96; 254/134.5; 73/151

[56] References Cited

U.S. PATENT DOCUMENTS

| | | | |
|---|---|---|---|
| 1,177,984 | 4/1916 | Beene | 254/134.5 |
| 2,742,259 | 4/1956 | Boucher | 254/134.5 |
| 2,776,564 | 1/1957 | Montgomery et al. | 166/64 X |
| 2,871,946 | 2/1959 | Bigelow | 166/64 |
| 2,876,413 | 3/1959 | Saurenman et al. | 166/250 UX |
| 3,375,885 | 4/1968 | Scott et al. | 175/94 X |
| 3,405,772 | 10/1968 | Wisenbaker et al. | 175/94 X |
| 3,890,905 | 6/1975 | Clavin | 254/134.5 X |
| 4,031,750 | 6/1977 | Youmans et al. | 73/151 |

FOREIGN PATENT DOCUMENTS

| | | | |
|---|---|---|---|
| 1046780 | 12/1953 | France | 254/134.5 |

*Primary Examiner*—Stephen J. Novosad
*Attorney, Agent, or Firm*—Robert W. Mayer

[57] ABSTRACT

Apparatus for aiding a well logging instrument in traversing highly deviated boreholes including a plurality of extensible arms mounted in the elongated logging instrument, each arm terminating in a pad member which includes a toothed wheel or gear mounted therein but extending outside the pad. When the arms are extended, moving the pad members outward and away from the logging instrument toward the borehole wall, the toothed wheels engage the mud cake or the borehole wall. A motor is effectively connected to the toothed wheels through a plurality of shafts, universal joints and interconnecting gears for rotating the toothed wheels to move the logging instruments up or down the borehole length. By mounting the toothed wheels within the pad members at an angle other than parallel to the axis of the borehole such that an auger-like movement of the logging instrument is produced, the drive force exerted on the logging instrument is amplified.

11 Claims, 9 Drawing Figures

METHOD AND APPARATUS FOR LOGGING INCLINED EARTH BOREHOLES

BACKGROUND OF THE INVENTION

This invention relates generally to apparatus for logging earth boreholes and more specifically to methods and apparatus which utilize means in addition to gravity for assisting the well logging instrument in traversing deviated earth boreholes.

It has become relatively common within the last few years to drill wells in search of oil and gas and the like with a portion of the bore deviating from the usual vertical orientation thereof. The deviation or inclination may extend for a considerable distance, sometimes returning to the usual vertical orientation. In some instances, such boreholes may extend past 90 degrees from the vertical and actually be extending in the up direction for some distance.

It is well known in the art of drilling such wells to attempt the logging of the formations surrounding such boreholes with logging instruments run into the well bore on a wireline and/or a cable to perform various operations. Such tools usually depend upon the force of gravity to permit positioning of the well tools at the desired formation within the well bore.

Manifestly, the relatively horizontal angle of the deviated portion of the well bore will not permit the wireline actuated tools, to move into the lower portion of the well bore since friction of the logging tool in the deviated portion works against the force of gravity. Thus it has become essential to provide some means of causing the well logging instrument to pass through the deviated portions of the well bore.

An additional problem commonly associated with such boreholes relates to the instability of some formations penetrated by the well bore, which results in borehole diameter changes, some of which are very abrupt. Ledges are thus formed and the logging instrument lodges against these ledges.

Another problem exists in a deviated borehole when the cable used to raise and lower the logging cable becomes "key seated". The term "key seated" refers to the situation where, due to well bore deviation or passing over a ledge within the borehole, the logging cable wears a groove or slot in the ledge. The friction caused by the logging cable passing within the groove makes it appear from surface indications that the downhole logging instrument is lodged within the borehole. Further compounding the problem is the fact that since the cable, not the logging instrument, is the source of friction the cable cannot be freed by "pulling loose". "Pulling loose" consists of exerting sufficient force on the cable from the surface to separate the cable from the instrument at the connection point between the two. The successful procedure results in the loss of the instrument but allows retrieval of the cable to the surface. The instrument can later be recovered by an operation termed "fishing" which is well known in the art of well drilling operations.

Yet another problem encountered when a cable becomes "key seated" occurs when the instrument is being removed or upwardly traversing the borehole. The instrument will become lodged at the point of "key seating", its upper portion actually attempting to pass into the groove created by the cable passing over the formation.

Thus, it has proven difficult to adequately log the earth formations surrounding these deviated sections utilizing only gravitational force for descent. While some prior art methods have addressed the problem of assisting the downward traverse of the instrument through the borehole, none have also addressed the further problem of aiding the ascent of the logging instrument.

SUMMARY OF THE INVENTION

The present invention provides method and apparatus for traversing deviated sections of a borehole with a logging instrument. The method and apparatus provided leave in formations surrounding the deviated sections utilize an elongated logging instrument having expandable pad members. These pad members house drive wheels which extend beyond the pad members. The application of a drive force the wheels, causes rotation thereof, further causing the instrument to be propelled up or down the borehole depending on the direction of rotation of the wheels. The wheels are angularly mounted so the resulting movement of the instrument is an "auger" like pattern.

The foregoing and other features and advantages of the present invention will be apparent from the following detailed description of the invention taken with reference to the figures of the accompanying drawings.

DETAILED DESCRIPTION OF THE INVENTION

Figure 1:
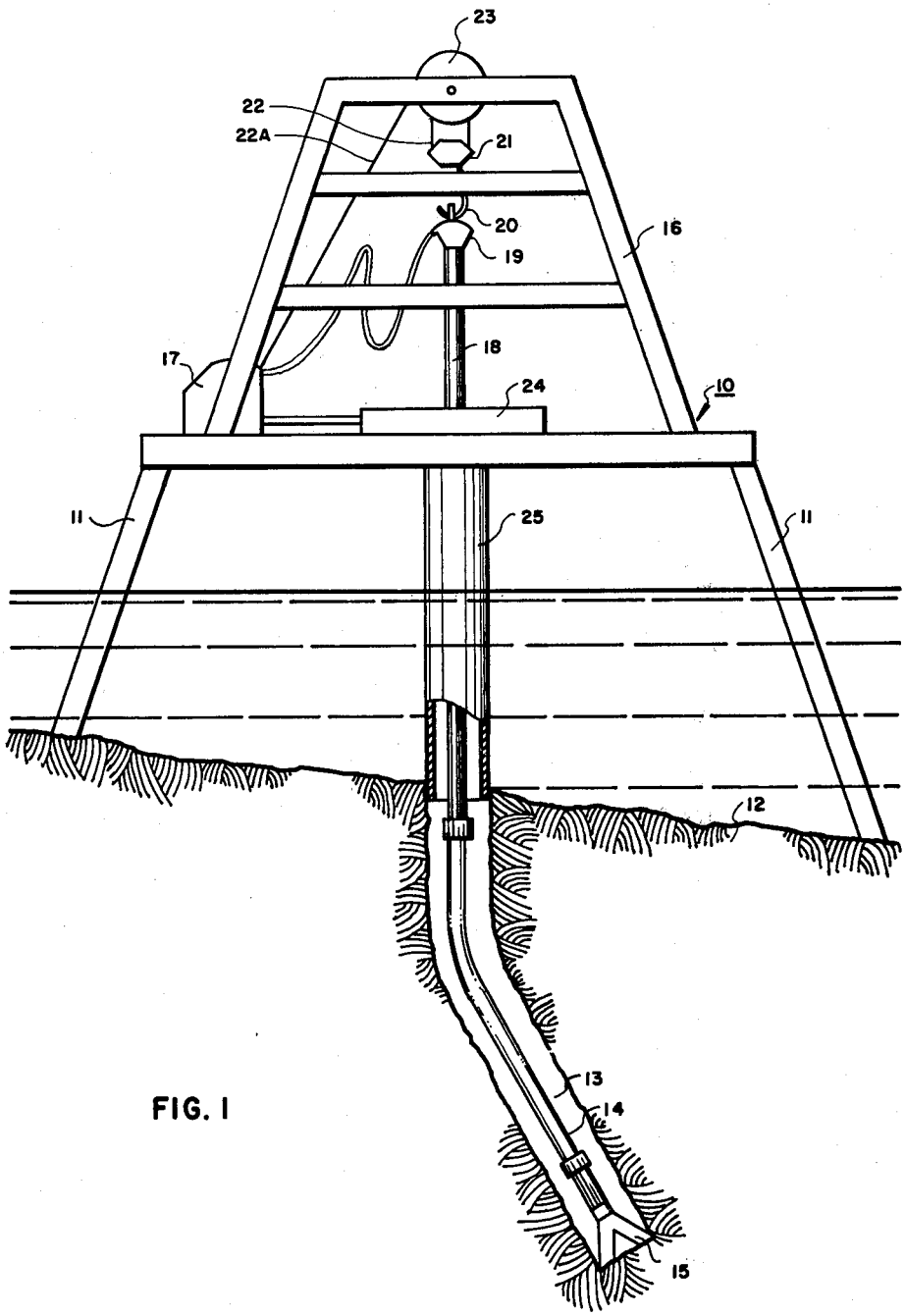
FIG. 1 is a schematic representation of a well drilling operation showing the drilling of a deviated earth borehole from an offshore platform.

Referring now to the drawing in more detail, FIG. 1 illustrates a conventional system for drilling an earth borehole having a high degree of deviation from true vertical. As is well known in the art, it is a common practice to drill such slanted wells from offshore platforms. A drilling platform having a plurality of legs 11 anchored on the ocean floor 12 has an earth borehole 13 drilled therefrom. Within the borehole 13 is a pipe string 14, to the lower end of which is attached a drill bit 15. A surface casing 25 maintains the integrity of the borehole 13 as is well known in the art. A derrick 16 with conventional drawworks 17 is mounted on the platform 10. The drill string 14 comprises a number of jointed sections of pipe terminating at its upper end in a kelly 18, followed by a swivel 19, a hook 20 and a travelling block 21 suspended by a drilling line 22 from a crown block 23. The drawworks 17 also drive a rotary table 24 which in turn transmits the drive to the kelly 18. One end of the line 22, namely the fast line **22*a*, is connected to the drawworks 17** which contains the motor or motors for manipulating the drill string. Although not illustrated, the other end of the drill line is secured to an anchor on the platform floor, that portion of line extending to the anchor from the crown block being generally referred to as the dead line. Again not illustrated, such an anchor member normally would include a winding-on drum and can also, if desired, contain a dead line sensor for monitoring the weight on the drill bit, for example, as shown in U.S. Pat. No. 3,461,978 to F. Whittle, issued Aug. 19, 1969.

In the operation of the system according to FIG. 1, it is quite conventional in drilling wells from such offshore platforms to drill the initial portion of the well substantially along a vertical line from the platform and then to angle off in the further drilling of the well. Such wells after angling off will oftentimes be inclined at an angle of 60 degrees to 70 degrees from vertical. It is with these types of highly deviated wells that the problem presents itself as to providing a log of the formations surrounding the well bore.

Figure 2:
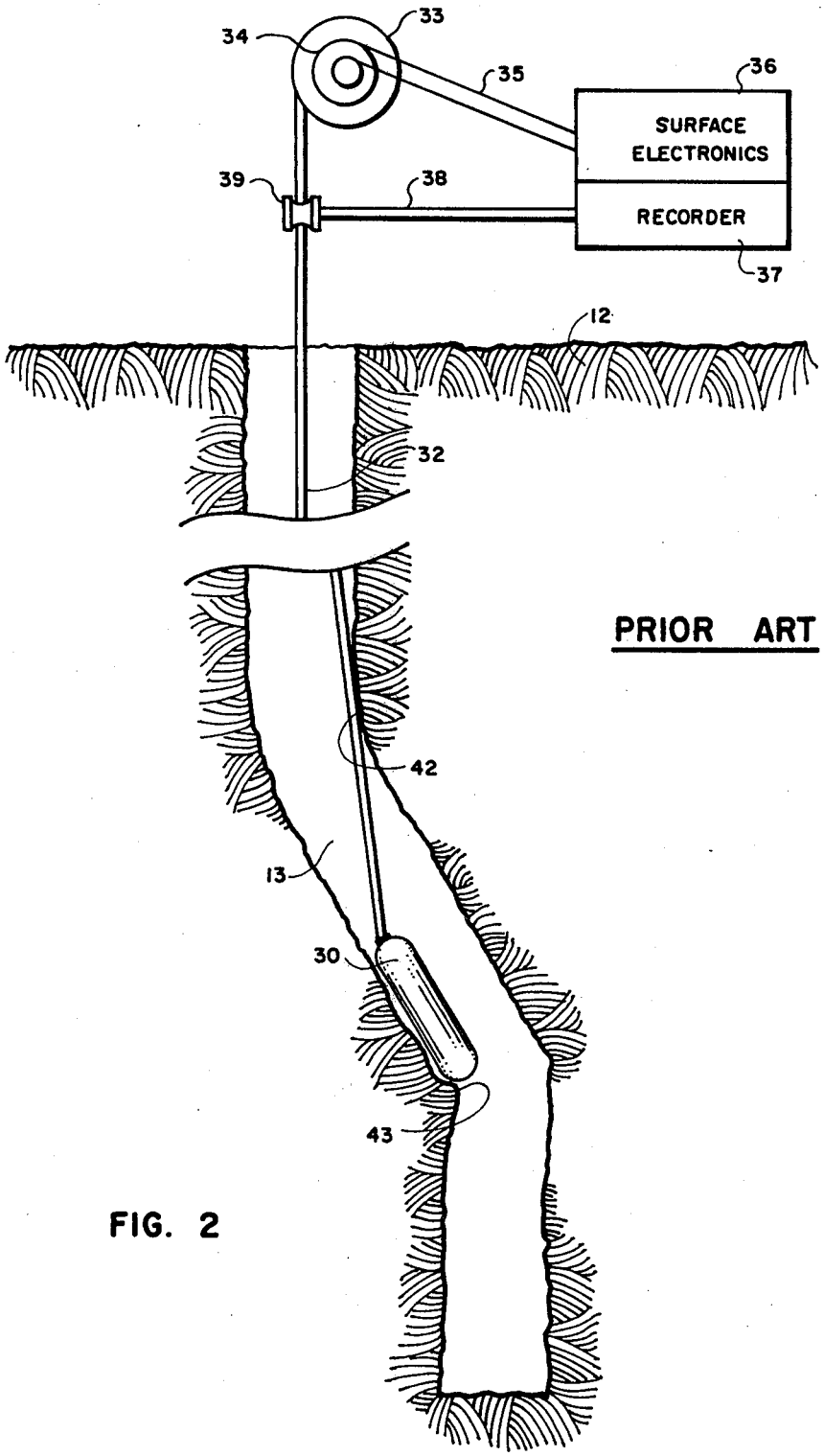
FIG. 2 is a schematic representation of a well logging operation showing a prior art well logging system encountering some of the problems associated with logging a highly deviated earth borehole.

Referring now to FIG. 2, there is illstrated schematically a well logging operation conducted in accordance with the prior art in which a portion of the earth's surface 12 is shown in vertical section. A well 13, which has been drilled as illustrated in FIG. 1, penetrates the earth's surface. Disposed within the well is a subsurface instrument 30 of the well logging system. The subsurface instrument 30 may be of any conventional type, for example, one which is adapted to conduct an induction, electric, acoustic, or any other of the conventional logs well known in the art. It should be appreciated that the particular type of well logging instrument forms no part of the present invention.

Cable 32 suspends the instrument 30 in the well 13 and contains the required conductors for electrically connecting the instrument 30 with the surface electronics 36. The cable 32 is is wound or unwould from drum 33 in raising and lowering the instrument to traverse the well 13. During the traversal, the signals from the well logging instrument 30 are sent up the cable 32. By way of the slip rings and brushes 34 on the drum 33, the signals are connected by the conduction 35 to the surface electronics 36. A recorder 37 connected to the surface electronics 36 is driven through the transmission 38 by the measuring reel 39 over which the cable 32 is drawn, so the recorder 37 associated with the surface electronics 36 moves in correlation with depth as the instrument 30 traverses the well 13. It is also to be understood that instruments such as the instrument 30 are generally constructed to withstand the pressures and the mechanical and thermal abuses encountered in logging a deep well.

In the operation of the system illustrated in FIG. 2, the cable is touching one ledge of the formation 42 or may even be "key seated" therein, and the instrument 30 has come to rest against another such ledge against another such ledge 43 located within the borehole. Ledge 43 makes it exceedingly difficult, if not impossible, for the instrument 30 to traverse the earth borehole merely by its own weight.

Figure 3:
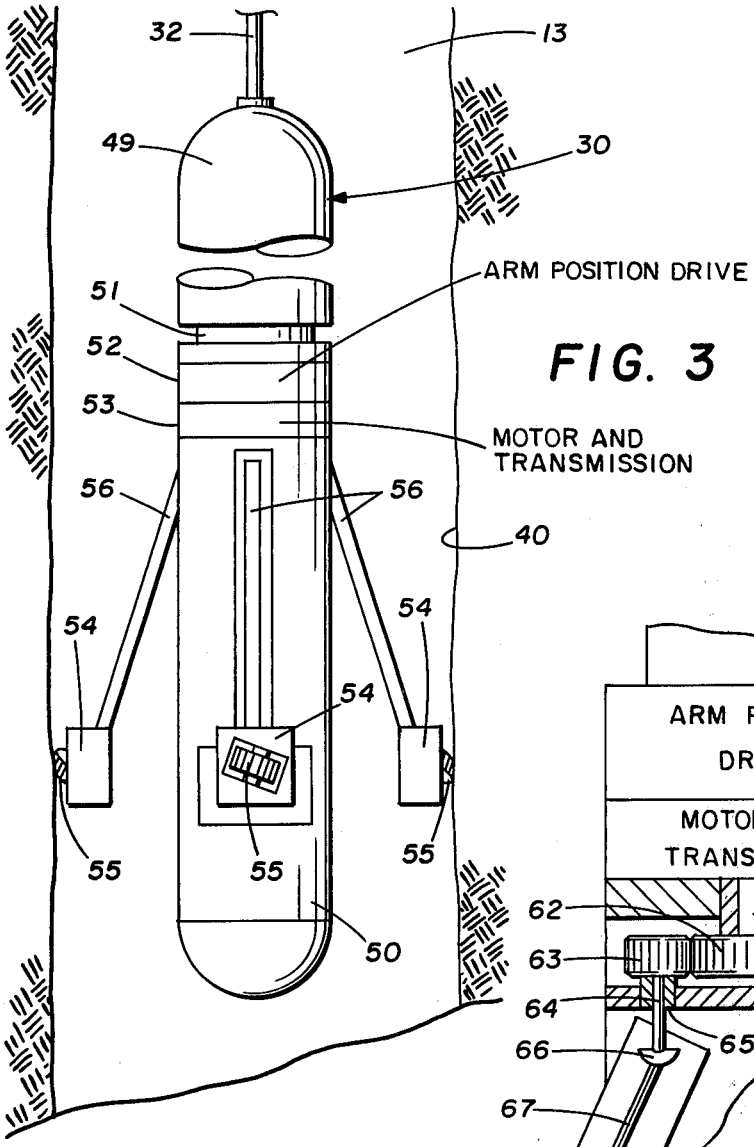
FIG. 3 is a schematic representation showing the drive mechanism positioned for aiding the well logging instrument in traversing the boreholes in accordance with the present invention.

Referring now to FIG. 3, there is schematically illustrated a well logging instrument 30, in accordance with the present invention, suspended in a section of borehole 13, by means of a cable 32. The instrument 30 is comprised of an elongated body member 49 which houses downhole electronics logging circuits (not shown). The subsurface circuits may be of any conventional type, for example, one which is adapted to conduct an electric, induction, acoustic, or any other of the conventional logs well known in the art. A swivel joint 51 couples the lower section of the body member 50 with the circuit housing portion. Electrical conductors (not shown) pass through the swivel joing 51 by way of slip rings and brushes coupling the arm position unit 52 and the motor assembly 53 with the surface. The arm position unit 52 is of the type well known in the art of the well bore logging and can be either hydraulic or electrical. The lower housing portion 50 is adapted with a plurality of pad members 54 each of which houses a toothed wheel or gear 55 and is pivotally coupled to the body 50 by arms 56.

Figure 4:
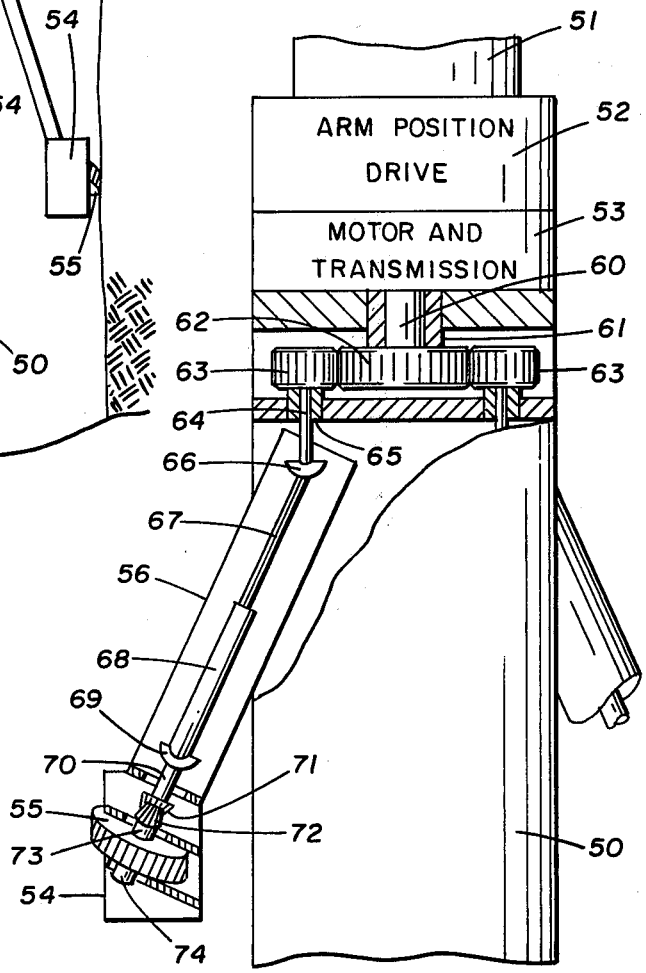
FIG. 4 is a partial cross-sectional view of the drive mechanism of FIG. 3 showing a drive train for providing rotational force required to move the apparatus.

The operation of the present invention can best be understood by first referring to FIG. 4, a partial enlarged schematic view, partly in cross section, illustrating the drive assembly utilized to cause the instrument to power its way in and out of a borehole. The housing 50 enclosed the arm position drive unit 52 and an electric motor and transmission assembly 53. A drive shaft 60 extends from the assembly 53 passing through a bearing 61 and end fitted with a spur gear 62. Spur gear 62 is in mesh with a plurality of other spur gears 63, one for each arm unit. Each second spur gear 63 is affixed to a shaft 64 passing through a bearing 65 and terminating a flexible coupling such as a U-joint 66. The U-joing 66 couples drive shaft 64 to a shaft 67 located within the arm member 56. Shaft 67 is adapted with a slidable spline joint 68 allowing arm 156 to be extended from and retracted to the instrument body 50A. The lower extremity of shaft 67 is fitted with a second U-joint 69 connected to shaft 70 fitted with a bevel gear 71. Bevel gear 71 is in mesh with a second bevel gear 72 shaftable connected to toothed wheel or gear 55 held in place within pad member 54 by bearings 73 and 74 protruding beyond the face of the pad member 54.

Figure 5:
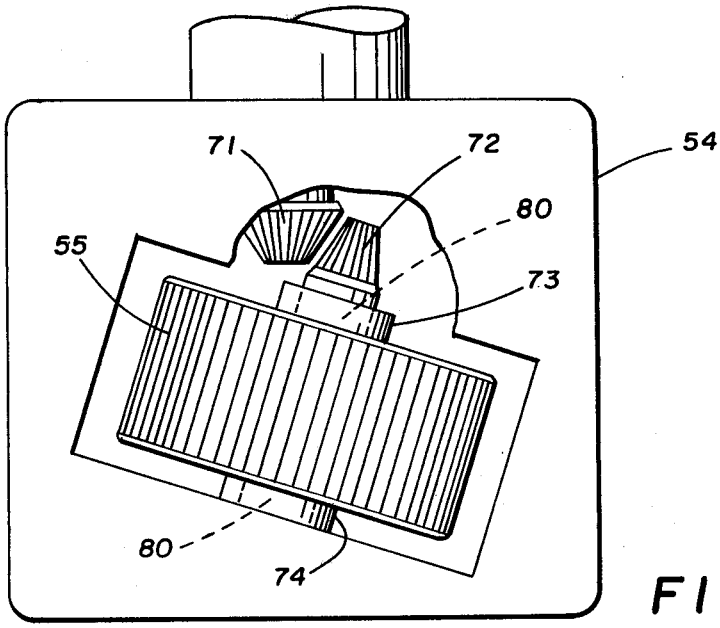
FIG. 5 is an enlarged schematic view, partially cut away, showing a toothed wheel mounted within a wall-engaging pad member.

The toothed wheel or gear 55 mounted within the pad 54 is better illustrated by reference to FIG. 5, an enlarged frontal schematic view, partially in cut away, of a pad member 54 housing the toothed wheel 55. The wheel 55 is held in place by means of shaft 80 positioned within bearings 73 and 74 allowing rotation of the wheel 55. The toothed wheel or gear 55 is mounted at a preselected angle, the purpose of which will be explained in detail in reference to the operational explanation of FIG. 3. Gears 71 and 72 provide the rotational drive to wheel 55 and by the use of bevel gears allow the angular mounting.

Again referring to FIG. 3, in the operation of the invention as illustrated, the instrument 30 is lowered into the borehole 13 by means of the cable 32. When the instrument enters a highly deviated portion of the borehole the force of gravity will no longer be sufficient to cause descent of the instrument and it will come to rest upon the lower borehole wall. When tool stoppage is sensed at the surface, the arm position unit 52 is activated causing the pad members 54 to be extended outwardly until the toothed wheels or gears 55 are urged into contract with the borehole wall. The outward extension of the arms 56 will cause a centralizing effect upon the lower portion of the instrument. Once the wheels 55 have been urged into intimate contact with the wall, power is supplied by means of cable 32 from the surface to the motor 53.

Returning now to FIG. 4, power supplied to the motor 53 causes rotation of shaft 60 and spur gear 62 further causing rotational force to be transferred to spur gear 63 and shaft 64. U-joints 66 and 69 combine with sliding spline connection 68 to allow rotational force to be coupled by shaft 67 when the arm 156 is in an extended position. Rotation at U-joint 69 is transferred by the meshing bevel gears 71 and 72 to provide drive to the toothed wheel or gear 55 contacting the borehole wall.

The toothed wheel 55 has a rotational torque T which is supplied by the above described motor 53 and connecting shafting 60, 64, 67 and 70.

Figure 6:
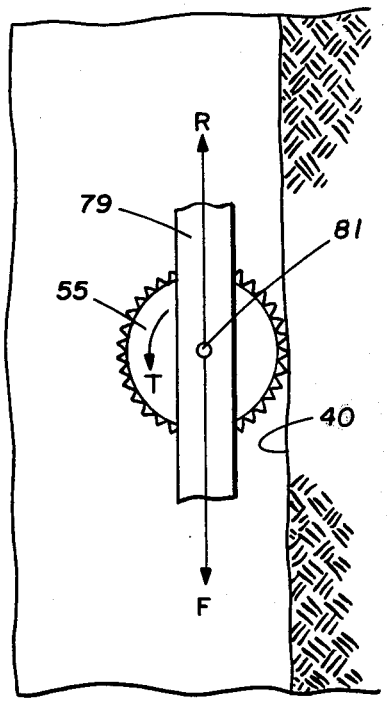
FIG. 6 is a schematic representation of a drive wheel mounted so that the angle between the axis of the borehole and a plane generated by the diameter of the wheel is zero.
Figure 7:
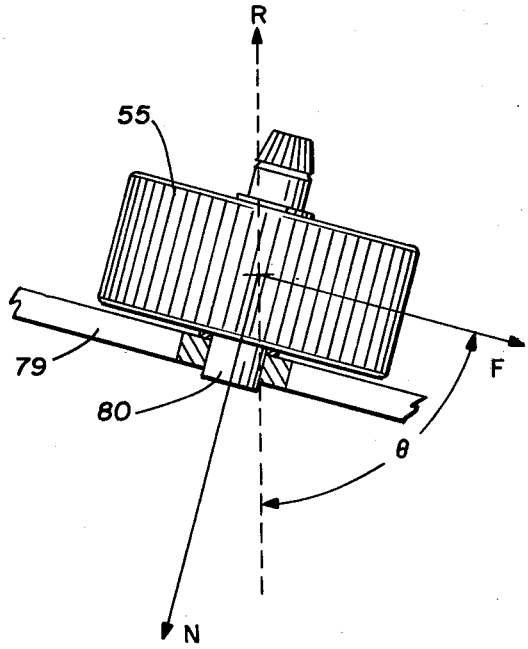
FIG. 7 is a shematic representation of the drive wheel of the present invention showing the mounting of the wheel at an angle other than zero.
Figure 8:
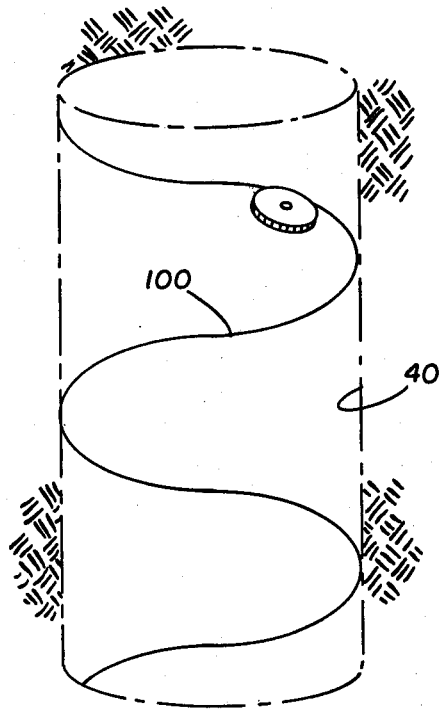
FIG. 8 is a schematic representation showing the path of travel within a borehole of a wheel in FIG. 7 mounted at some angle other than zero.

Referring to FIG. 6, FIG. 7, and FIG. 8, the application of the rotational force will be described in greater detail. First examining FIG. 6, there is illustrated the toothed wheel 55 engaging the borehole surface 40 and mounted so that wheel rotation will result in travel generally parallel to the borehole axis. The torque T applied to the wheel 55 will cause a force F to be developed at the wheel shaft 80, this force F being transmitted to a carrier mechanism 70 which captures the wheel 55 and shaft 80 and will cause the carrier mechanism 91 to be propelled in the direction of F. An obstructing force R acting upon the carrier mechanism 70 opposite to F will tend to impede the movement of the carrier 70, however, the carrier will continue to advance until the state of F=R is reached. Thus, the force R required to stop the carrier progression is F. If, as in FIG. 6, the angle between the axis of the borehole and the plane generated by the diameter of the toothed wheel 55 is zero, the wheel 55 will travel in a straight line down the wall 40 parallel to the axis of the borehole. The velocity of the wheel 55 and shaft 80 travel along the surface 40 will depend on the rotational velocity of the shaft 80 and the diameter of the wheel 55.

Now suppose that the angle between the axis of the borehole and the plane generated by the diameter of the toothed wheel is not zero but is some angle $\theta$, as represented by FIG. 7. The force exerted by the wheel shaft 80 onto the carrier mechanism 74 is again F and the force is directed toward intended wheel travel. If an obstructing force R exists that is oppositely directed to that of the motivating force F, the magnitude it must possess to stop the progression of the carrier 79 is F, as asserted above. Within the well bore, with an angularly mounted wheel, the obstructing force R will not generally be directly opposite that of F but will be directed parallel to the axis of the borehole and the angle between the obstructing force R and F will also be $\theta$. Under this condition, the force R tends to impede the progression of the carrier 70 down the cylinder and the toothed wheel 455 pressing against the carrier 70 now generates a thrust force N normally 90° to that of F. At this time there will be three forces F, N and R acting upon the carrier 91. Resolving these forces leads to the following equations:

$$F \sin\theta = N \cos\theta$$

$$F \cos\theta + N \sin\theta = R$$

or $$N \cos\theta = F \sin\theta$$

$$R - N \sin = F \cos\theta$$

Since F is a known quantity we can readily solve R and N.

$$R = \frac{\begin{matrix} F \sin\theta \cos\theta \\ F \cos\theta - \sin\theta \end{matrix}}{\begin{matrix} 0 \quad \cos\theta \\ 1 - \sin\theta \end{matrix}} =$$

$$\frac{F(\sin^2\theta + \cos^2\theta)}{\cos\theta} = \frac{F}{\cos\theta}$$

and $$R = F/\cos\theta$$

$$N = F \tan\theta$$

The obstructing force R required to stop the progression the carrier 79 now depends upon $\theta$ as well as F. If $\theta$ if 0°, the force R required to stop the carried 79 is F as above described. If $\theta$ is increased to 45° the force R required is 1.4F and if $\theta$ is further increased to 60° the obstructing force R is 2F. As has been described, as $\theta$ continues to approach 90° the obstructing force R required to stop the progression of the carrier mechanism 79 can be several multiples of F. For actual operation, the selection of a particular angle $\theta$ will depend upon the ratio of the magnitude of the expected obstructing force R and the available force F at the wheel shaft 80. It is apparent that as the wheel rotates, the path of progression is not directly down the borehole wall parallel to the axis of the borehole but as illustrated by FIG. 8, is now helical around the axis of the well bore along line 100.

When the toothed wheels are mounted in a number of arm member pads 54, as in FIG. 3, a drive force will be provided causing the instrument to move within the borehole utilizing an "auger" action. The lower portion will move downhole through deviated sections, rotating about the swivel joint 51 and pulling the remainder of the logging instrument 30 through the deviated section.

Figure 9:
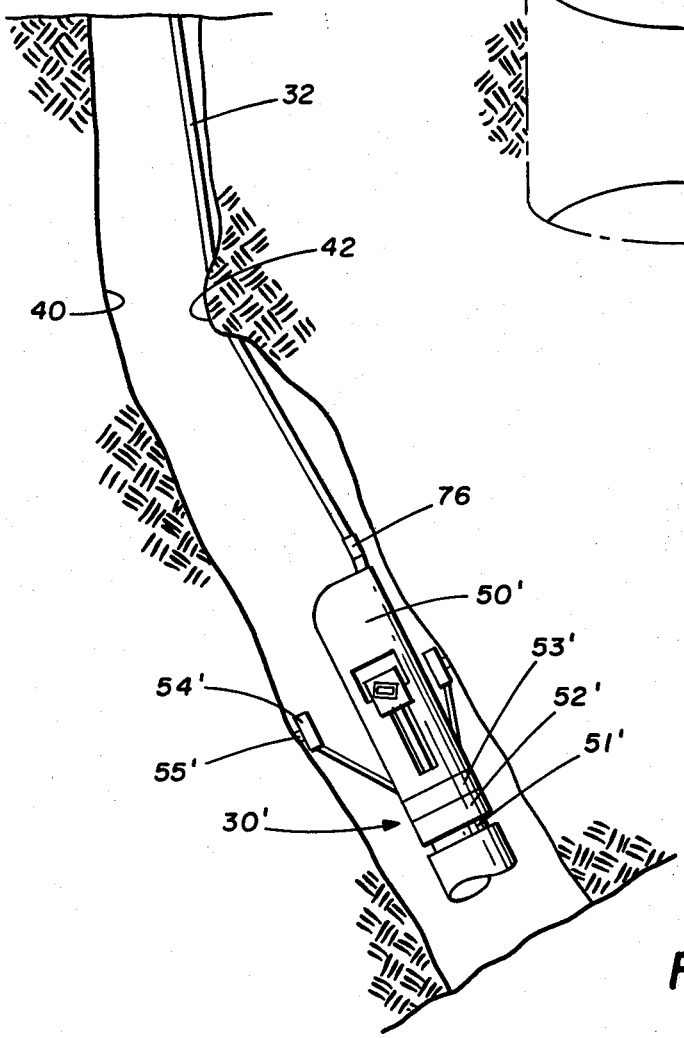
FIG. 9 is a schematic representation of an alternate embodiment of the present invention whereby the well-engaging pad-members are affixed at the upper extremity of the logging instrument.

FIG. 9 is a schematic illustration of an alternate embodiment of the disclosed invention. In FIG. 9 there is shown a portion of the cable 32 which has became "key seated" in a borehole ledge 42. In the present embodiment, the device to aid passage through the borehole is affixed atop the instrument 30' by means of the swivel joint 51' and is coupled to the logging cable 32 by a second swivel joint 76 mounted off the center line of the instrument 30.

In the prior art, as the instrument proceeds up the borehole, the upper portion would become lodged against the well bore wall at ledge 42 due to the cable 32 passing within a slot created by the cable 32 being pulled across the formation. In the operation of the instrument illustrated by FIG. 9, the twisting or auger effect of the apparatus as it proceeds up the borehole will cause the cable 32 to be whipped about corresponding to rotation of the apparatus. This whipping will tend to cause the cable 32 to be pulled from the point of "key seating" within ledge 42, freeing the cable and further allowing passage of the logging instrument up the borehole.

Thus, there have been illustrated and described herein the preferred embodiments of the present invention which provide methods and apparatus to facilitate the movement of the well logging apparatus through the borehole and to aid in dislodging the cable from a "key seated" state. However, those skilled in the art will recognize that obvious modifications can be made to the preferred embodiments without departing from the spirit of the invention. For example, instead of a single toothed wheel or gear within a pad member several wheels could be contained therein to provide added rotational drive. Furthermore, instead of using a single motor drive and associated linkage each pad could contain a separate motor to drive the corresponding wheel.

The embodiments of the invention in which an exclusive property or privilege is claimed or defined as follows:

1. A method of logging formations surrounding an earth boreholes, comprising the steps of:

causing a well logging instrument to traverse an earth borehole by gravitational force;

detecting stoppage of said instrument within said borehole;

implanting an auger-like movement to said instrument in response to detection of said stoppage to facilitate movement of said instrument through said borehole.

2. Method of logging as recited in claim 1, wherein facilitating movement of said instrument comprises the additional step of supplying a rotational force to gears extending beyond said instrument.

3. Well logging apparatus for traversing earth borehole, comprising:

an elongated logging instrument adapted to traverse said earth borehole;

a plurality of pad members coupled to said elongated instrument;

at least one wheel means housed within, and extending beyond each of said pad members;

means for extending said wheel means within said pad members into contact with the formations surrounding said earth borehole; and activatable means within said logging instrument for facilitating movement of said logging instrument through said inclined portions of said borehole.

4. The apparatus according to claim 3, including arm means pivotally connecting said pad members with said logging instrument and allowing diametrical movement of said pads in relation to said logging instrument.

5. The apparatus according to claim 3, wherein toothed wheels are mounted within each of said pad members at an angle to said borehole to provide an auger-like movement to said apparatus.

6. The apparatus according to claim 3, wherein said activatable means comprises means to propel said instrument along said borehole.

7. The apparatus according to claim 3, wherein said activatable means comprises a means to supply rotational force to each of said wheel means.

8. The apparatus according to claim 7, wherein said means to supply rotational force to each of said wheel means comprises a motor within said logging instrument coupled by means of shafts, gears and U-joints to said wheel means.

9. Apparatus for logging the formations surrounding a deviated section of an earth borehole, comprising:

an elongated well logging instrument connected to the earth's surface by a well logging cable;

at least two well-engaging pad members;

arms pivotally coupling said pad members with said elongated well logging instrument for allowing diametrical movement of said pad members;

a toothed wheel means mounted within each of said pad members and extending beyond said pad members;

means responsive to a remote control signal for urging said toothed wheel means into intimate contact with said formations surrounding said deviated section of said earth borehole to be logged; and means for providing rotational force to said toothed wheel means whereby said force will cause said toothed wheel means to propel said logging instrument along said deviated section of said borehole with an auger-like movement.

10. The apparatus according to claim 9, wherein said toothed wheel means are mounted at an angle to said borehole and travel a generally helical path about said borehole.

11. The apparatus according to claim 9, further comprising rotational means allowing the portion of said elongated instrument coupled to said pad members to rotate freely in response to the helical path generated by said toothed wheel means.

* * * * *